United States Patent [19]

Bolza-Schünemann

[11] 4,147,337

[45] Apr. 3, 1979

[54] SHEET TRANSFER APPARATUS

[75] Inventor: Hans B. Bolza-Schünemann, Würzburg, Fed. Rep. of Germany

[73] Assignee: Koenig & Bauer Aktiengesellschaft, Würzburg, Fed. Rep. of Germany

[21] Appl. No.: 855,856

[22] Filed: Nov. 30, 1977

[30] Foreign Application Priority Data

Dec. 11, 1976 [DE] Fed. Rep. of Germany ..... 2656267

[51] Int. Cl.[2] ..... B41F 13/64

[52] U.S. Cl. ..... 270/19; 270/21; 270/48; 270/60; 270/71

[58] Field of Search ..... 270/6, 7, 13, 14, 10, 270/11, 19, 38, 42, 60, 47–50, 21, 76–77; 83/346–347, 659

[56] References Cited

U.S. PATENT DOCUMENTS

| | | | |
|---|---|---|---|
| 1,048,745 | 12/1912 | Schroeder | 270/60 |
| 1,499,106 | 6/1924 | Hallewell | 270/76 |
| 1,691,891 | 11/1928 | Meisel | 270/60 |
| 1,797,278 | 3/1931 | Weis | 83/347 |
| 3,174,372 | 3/1965 | Huck | 83/346 |
| 3,521,878 | 7/1970 | Bolza-Schunemann | 270/76 |

*Primary Examiner*—Edgar S. Burr
*Assistant Examiner*—A. Heinz
*Attorney, Agent, or Firm*—Jones, Tullar & Cooper

[57] ABSTRACT

A sheet transfer apparatus which can vary the effective spacing between the cutting cylinder and the transfer cylinder and between the transfer cylinder and the folding blade cylinder in a folding cylinder group for a rotary web-fed printing press is disclosed. The cutting knives and complementary counter cut bars of the cutting and transfer cylinders, respectively, are radially adjustable on the cylinders to insure that the webs of paper are accurately cut into sheets and transferred to the pins of the folding blade cylinder. The spacings can be adjusted to allow the folding cylinder group to operate in straight, single collect, and double collect productions.

9 Claims, 4 Drawing Figures

SHEET TRANSFER APPARATUS

FIELD OF THE INVENTION

The present invention is directed generally to an apparatus for sheet transfer between a transfer cylinder and a folding blade cylinder, each equipped with pins, in web-fed rotary printing machines. More particularly, the present invention is directed to a sheet transfer apparatus having means to adjust the effective spacing between the transfer and folding blade cylinders. Most specifically, the present invention is directed to means for adjusting the radial extension of cutting knives and complementary counter cut bars carried by the cutting and transfer cylinders, respectively.

DESCRIPTION OF THE PRIOR ART

Folders having sheet transfer means which include sets of pins for the production of thick folded products are known generally as is shown, for example, in German Pat. No. 17 61 074. Furthermore, a transfer and collecting cylinder may be seen in the German Published Accepted Patent Application No. 10 74 057 which bears a plurality of press ring segments on its periphery. It is an object of the press ring segments to exert pressure on the trailing stack of sheet sections on the folding blade cylinder for a suitable period of time long enough to prevent any possible dislocation of the stack of sheet sections on the folding blade cylinder, until the pins are withdrawn and the folding procedure has been completed.

The folder in accordance with the German Published Accepted Patent Application No. 10 74 057 allows for the production of thick products, and the folder in accordance with the German Pat. No. 17 61 074 facilitates the production of extremely thick products. The thick products are not produced in one operation, but by collecting a plurality of sections of sheets onto each other. Therefore, it is necessary to adjust the distance between the cylinders concerned, for example, between the combined transfer and counter cut groove cylinder and the collecting cylinder, in conformity with the maximum thickness of the products to be produced by collecting sections of sheets onto each other. Therefrom large cylinder gaps, for example of 10 mm of thickness and more, are required. Double collect run production, for example, requires four operative steps to collect the necessary sections of sheets on the collecting cylinder. That means, that for the first three operative steps, the gap between the transferring cylinder and the collecting cylinder is unsuitably large. If, for example, the same folder is also to be used for straight run production; i.e., continuously with only one thin section of sheets, the apparatus must be run with a far too large gap between the cylinders. In sheet transfer devices which utilize pins, however, too large a gap between the cylinders concerned may, under certain circumstances, cause damage to the sections of sheets to be transferred, unless the speed of production is reduced to an unacceptably low rate.

SUMMARY OF THE INVENTION

It is an object of the present invention to provide a sheet transfer apparatus having means to adjust the effective spacing between the transfer and folding blade cylinders.

Another object of the present invention is to provide a sheet transfer apparatus in which the effective spacing of complementary cutting knives and counter cut bars remains the same.

Yet a further object of the present invention is to provide a sheet transfer apparatus capable of being varied to run in straight, collect and double collect productions.

Still another object of the present invention is to provide a sheet transfer apparatus including indicia to indicate the degree of adjustment of the counter cut bars and/or cutting knives.

The folding cylinder group of a rotary web-fed printing press includes a cutting knife cylinder, a counter cut bar and transfer cylinder, and a folding blade cylinder. Both the transfer and folding blade cylinders are provided with peripheral pin sets which secure the cut sheet stacks to their peripheries. Since the folding cylinder group may operate in straight, collect, or double collect production, the effective spacing between the cutting blade, transfer, and folding blade cylinders should be variable to insure that the cut sheet stacks are properly impaled on the pin sets. In the sheet transfer apparatus in accordance with the present invention this effective spacing is variable through the use of generally trapezoidal or triangular cutting knife and counter cut bar support blocks which are received in radial grooves in their respective cylinders. Sliding wedges contact the inclined faces of the bar and knife carrying blocks to radially adjust the protrusion of the knives and bars away from the faces of the cylinders. Suitable changes in projection of the knives and bars allows the operation of the folding cylinder group in straight, single collect, and double collect production.

Advantages obtained from the present invention are in particular that, for example, in a folder having sheet transfer by means of pins, the invention may be utilized in the production of extremely thick products as well as for the production of thin products, without damaging the pinned-up sections of sheets. Even if the products are periodically of different thickness during the collecting procedure, they are always pinned with suitable pressure to push them down to the base of the pins. Furthermore, the formation of paper scraps is avoided, because every section of sheets passes only once through the cutting point.

BRIEF DESCRIPTION OF THE DRAWINGS

While the novel features of the sheet transfer apparatus in accordance with the present invention are set forth with particularity in the appended claims, a full and complete understanding of the invention may be had by referring to the detailed description of a preferred embodiment as set forth hereinafter and as shown in the accompanying drawings in which:

DESCRIPTION OF A PREFERRED EMBODIMENT

Figure 1:
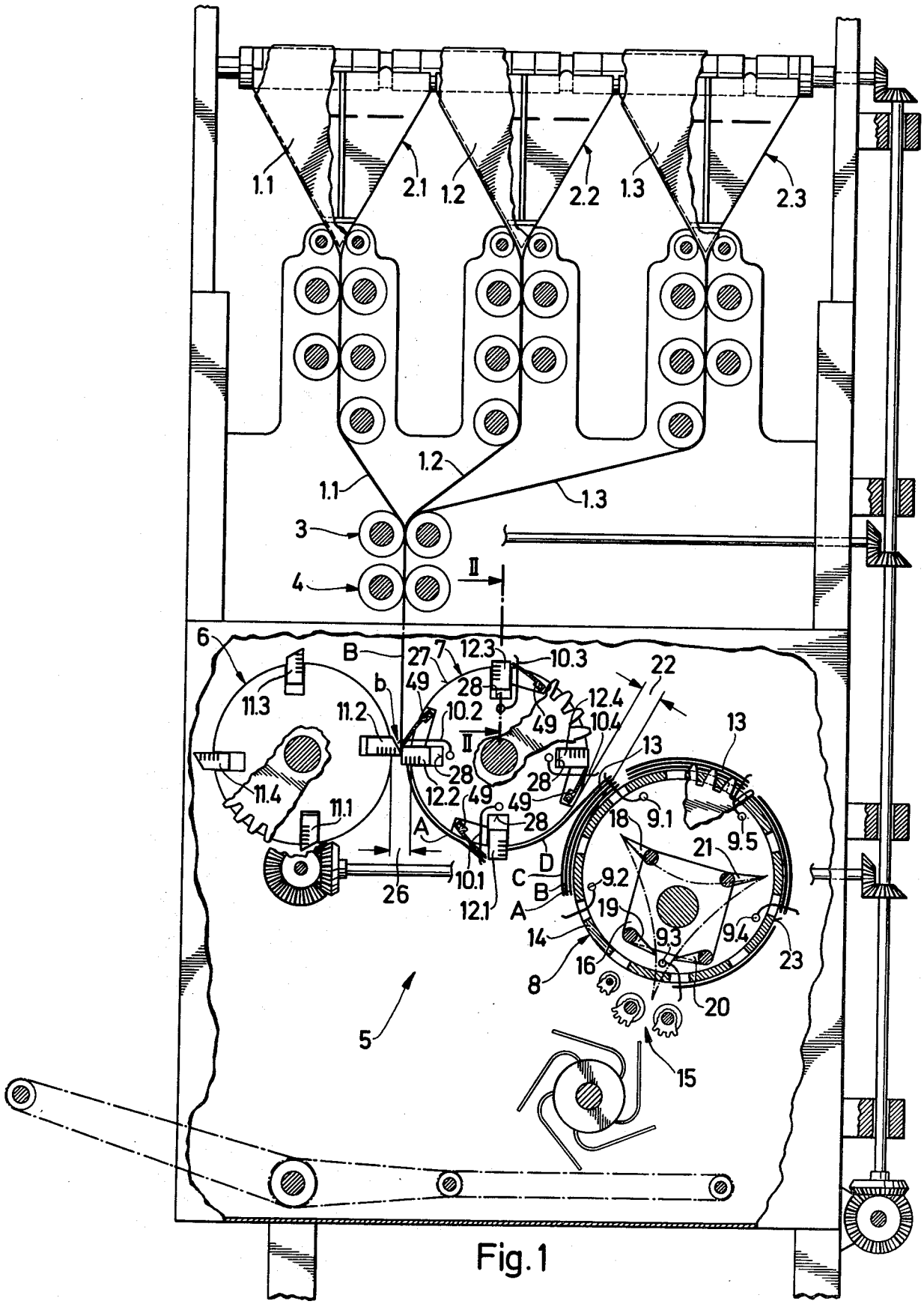
FIG. 1 is a schematic side elevation view of a preferred embodiment of a folder in accordance with the present invention which is capable of production of extremely thick and of thin products.

Turning now to FIG. 1, there may be seen a preferred embodiment of a sheet transfer apparatus in accordance with the present invention. As may be seen in FIG. 1, longitudinally folder paper ribbons 1.1, 1.2, 1.3 coming from one or a plurality of formers 2.1, 2.2, 2.3 pass over feed roll groups 3, 4 and into a folding cylinder group 5 which is comprised of a plurality of cylinders. The folding cylinder group 5 includes, for example, a 4/2 cutting knife cylinder 6, a 4/2 counter cut bar and transfer cylinder 7 which cooperates with the 4/2 cutting knife cylinder 6, and a 5/2 collecting and folding blade cylinder 8. The 5/2 collecting and folding blade cylinder 8 includes two portions which have different functions. It is comprised of a hollow collecting cylinder 14 having five portions or fields of equal length around its periphery, and a folding blade carrier 16 rotating within the collecting cylinder 14, which serves as driving means for folding blades 18 to 21. Selected ones of the folding blades 18 to 21 are capable of being optionally put out of service. The 5/2-collecting cylinder 14 carries five controllable sets of pins 9.1, 9.2, 9.3, 9.4, 9.5, equally spaced on its periphery 23. The counter cut bar and transfer cylinder 7 have at least one less field than the collecting cylinder 14 to which it is coupled with, in the preferred embodiment, there being four fields on the transfer cylinder 7. Each of the fields 7 of the transfer cylinder carries a controllable set of pins 10.1, 10.2, 10.3, 10.4. The control of the sets of pins 9.1 to 9.5 and 10.1 to 10.4 is set forth with particularity in German Pat. No. 18 01 419 and need not be described in detail. As is well know, the sets of pins 10.1 to 10.4 pin the consolidated paper ribbons 1.1 to 1.3 onto the 4/2 counter cut bar and transfer cylinder 7, before they are cut by the four knives 11.1 to 11.4 of the 4/2 cutting knife cylinder 6, the knives cooperating with the four complementary counter cut bars 12.1 to 12.4 of the combined 4/2 counter cut bar and transfer cylinder 7 to sever the ribbons 1.1 to 1.3 into individual sections of sheets or sheet stacks A, B, C, D. The sets of pins 10.1 to 10.4 of the 4/2 counter cut bar and transfer cylinder 7 secure the sections of sheets A to D to the transfer cylinder until the sheet stacks are transferred to the controllable sets of pins 9.1 to 9.5 of the 5/2 collecting cylinder 14 where the sheet stacks are folded by the folding blades 18 to 21 and a pair of folding rollers 15. The types of production which may be obtained by means of the folder shown in FIG. 1 are straight run production, single collect production, and double collect production. The function and operation of the folder is described in detail in the German Patent Application No. P 26 52 159.5, so that it will be superfluous to herein further describe it.

In straight run production each of the fields of the 5/2 collecting cylinder 14 receives one sheet section A, B, C, or D and carries it to the folding rollers 15. In single collect production each field of the 5/2 collecting cylinder 14 receives two sheet sections A and B, or C and D, and carries these to the folding rollers. In double collect production, four sheet sections A, B, C, D are collected one upon the other on each field of the 5/2 collecting cylinder 14 so as to form one sheet stack 13, each of which stacks is pushed by one of the folding blades 18 to 21 into the pair of folding rollers 15 and thus is folded so as to form a finished product. This structure of the former is particularly appropriate for the production of extremely thick products.

The gap 22, as shown in FIG. 1, between the 5/2 collecting cylinder 14 and the transferring cylinder, in this case the 4/2 counter cut bar and transfer cylinder 7, must be wider than the thickest product processed during the collection of the sheet stacks 13. This is the reason why large cylinder gaps 22 of 10 mm and more of width are required. In double collect production, collecting of the sheet sections A, B, C, and D is done in four operating steps. In the first three steps, the gap 22 between the transferring cylinder, for example the 4/2 counter cut bar and transfer cylinder 7, and the collecting cylinder, for example the 5/2 collection cylinder 14, will not be filled by the 1, 2, or 3 sheet sections so that the gap 22 will be too wide. The gap 22 is also too wide in the case when products are produced in straight run, since it is still necessary to provide the width of the gap 22 for a very thick double collected product. Particularly with respect to thin sections of sheets A to D, for example of 2 mm of thickness when the apparatus is operating in straight run or single collect production, there may be problems which occur at high speeds, if the gap 22 is too wide; for example, corners will be bent, or the sections of sheets will slip off the pins, because they are secured on the tops of the pins and are not pushed down to the base of the pin shafts.

Figure 4:
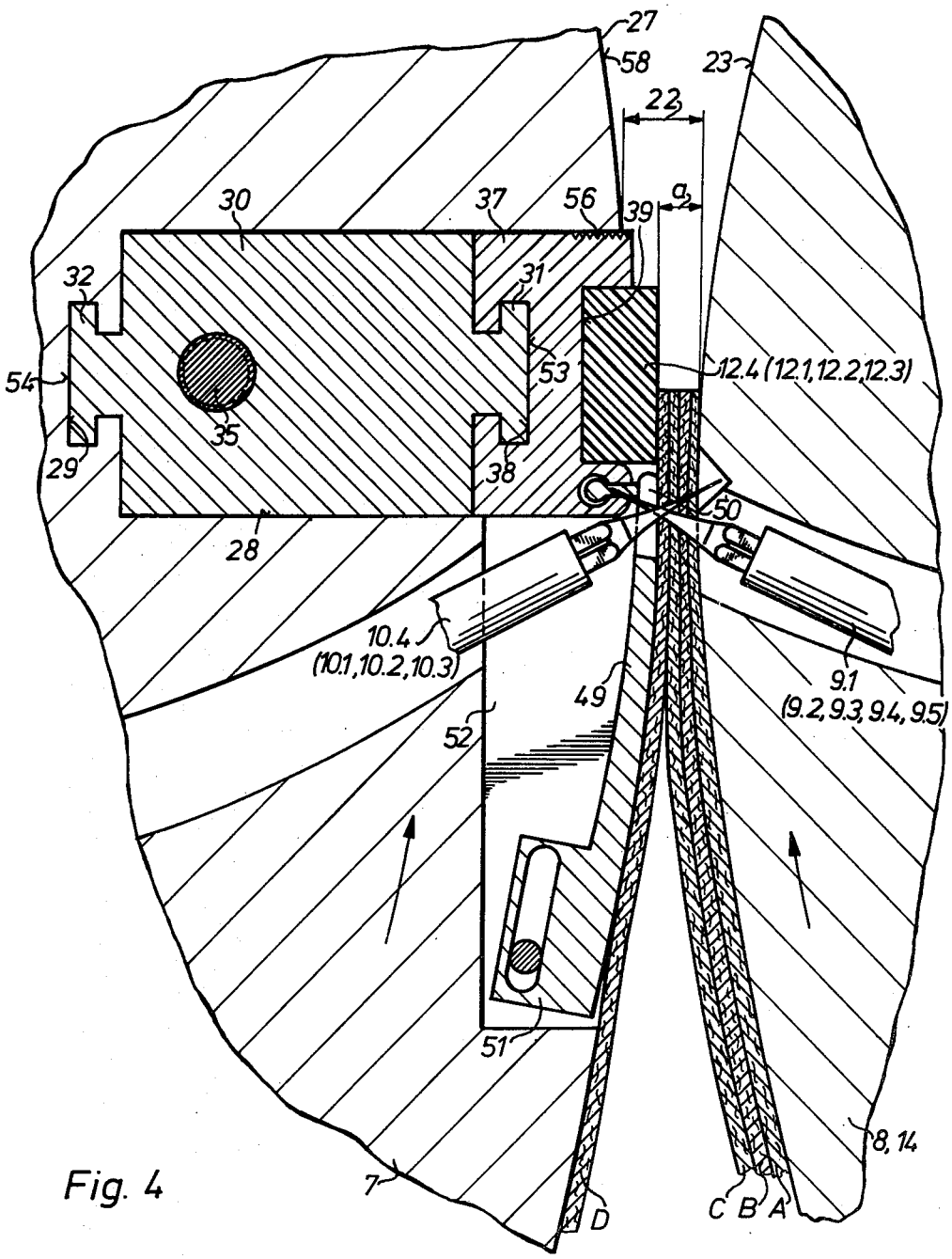
FIG. 4 is a schematic view of a portion of the sheet transfer apparatus of the present invention installed in a transfer cylinder, and coacting with a connected folding blade and collecting cylinder.

Such problems will be prevented, if the distance "a," as seen in FIG. 4, between a support, for example, a counter cut bar, for the leading edges of the sections of sheets A, B, C, D of a transferring cylinder, for example, of the 4/2 counter cut bar and transfer cylinder 7, and the periphery 23 of a collecting cylinder, for example, of the 5/2 collecting cylinder 14, is adjustable in accordance with the thickness of the sections of sheets A to D, which are collected upon each other. For example, if the cylinder gap 22 between the transferring cylinder 7 and the collecting cylinder 14 is of 10 mm thickness and with the thickness of the sections of sheets A, B, C, D being 2 mm, each of the supports for the sections of sheets A to D, for example, the counter cut bars 12.1–12.4, are adjusted to protrude outwardly 8 mm from the periphery 27 of the 4/2 counter cut bar and transfer cylinder 7 during straight run production. Due to this adjustment, the gap 22 is reduced from "a"=10 mm for example, to "a"=2 mm at the point where the sections of sheets A to D are transferred from the 4/2 counter cut bar and transfer cylinder 7 to the 5/2 collecting cylinder 14, so that each of the sections of sheets A to D is pressed onto the pins 9.1 to 9.5 of the 5/2 collecting cylinder 14 with sufficient force.

In a single collect production, the copy is produced in two operative steps; in the first step the section of sheets A of 2 mm thickness is pinned to one of the sets of pins 9.1 to 9.5 of the 5/2 collecting and folding blade cylinder 8. In the subsequent passage, the section of sheets B is collected on top of the section of sheets A. Thus, the thickness of the product to be folded would be 4 mm. In this case, two of the supports, for example, the counter cut bars 12.1 and 12.3 are adjusted to protrude 8 mm from surface 27 and the other two supports, for example, the counter cut bars 12.2 and 12.4, are adjusted so as to protrude 6 mm from the periphery 27 of the transferring cylinder 7.

In double collect product, the product to be folded is formed in four steps; for example, from 2 mm=section of sheets A to 4 mm=$A+B$, to 6 mm=$A+B+C$, and finally to 8 mm=$A\&B+C+D$ of thickness. Consequently, the relative supports for the sections of sheets A to D, for example, the counter cut bars 12.1 to 12.4 of the 4/2 counter cut bar and transfer cylinder 7, are adjusted so as to protrude for 8 mm, or for 6 mm, or for 4 mm, or for 2 mm, respectively, from the periphery 27 of cylinder 7. Due to the fact that the transferring cylinder, for example, the 4/2 counter cut bar and transfer cylinder 7, always has at least one field less than the subsequent collecting cylinder, for example, the 5/2 collecting cylinder 14, the rise of one sheet section A, or B, or C, or D up to the product to be folded, for example A+B, or A+B+C+D, is always repeated in the correct cycle of operative steps. The counter cut bar and transfer cylinder 7 further has the same number of fields around its periphery as the cutting knife cylinder 6, which coacts with it; for example, both are 4/2 cylinders.

The support for the leading edge of each of the sections of sheets A to D pinned to transfer cylinder 7 is provided by the front surfaces of the counter cut bars 12.1 to 12.4. The distance of protrusion of the cutting knives 11.1 to 11.4 from the periphery of the cutting knife cylinder, for example, of the 4/2 cutting knife cylinder 6, are also adjustable in a complementing manner to correspond with the heights of the supports such as the counter cut bars 12.1 to 12.4 of the transfer cylinder 7. The distance "b," as seen in FIG. 1, between the cutting knives 11.1 to 11.4 and the counter cut bars 12.1 to 12.4 coordinated to them, which are also the supports for the leading edge of the sheet section A, B, C, D, is always the same. The measure of the gap 26 between the 4/2 cutting knife cylinder 6 and the following cylinder, for example, the 4/2 counter cut bar and transfer cylinder 7, is in conformity with the measure of the gap 22. Accordingly, if a counter cut bar extends out 2 mm from the surface of cylinder 7, a complementing cutting knife will extend out 8 mm from the surface of cylinder 6 so that each bar and knife will extend across the space between the cylinders.

Figure 3:
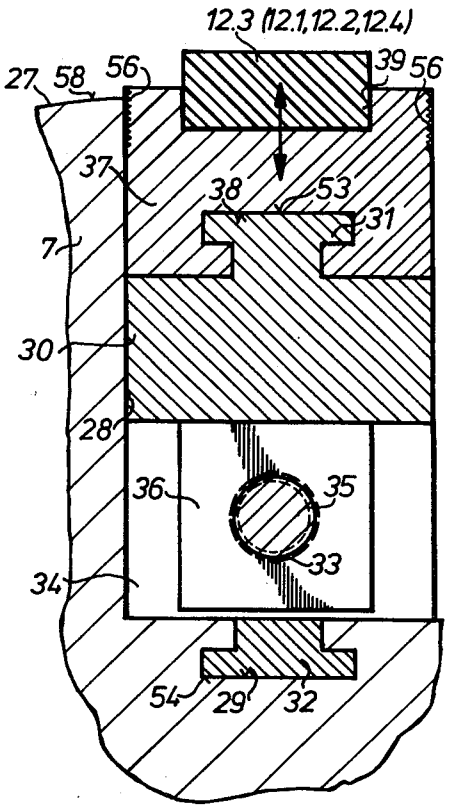
FIG. 3 is an elevation view, partly in section, taken along line III—III of FIG. 2.
Figure 2:
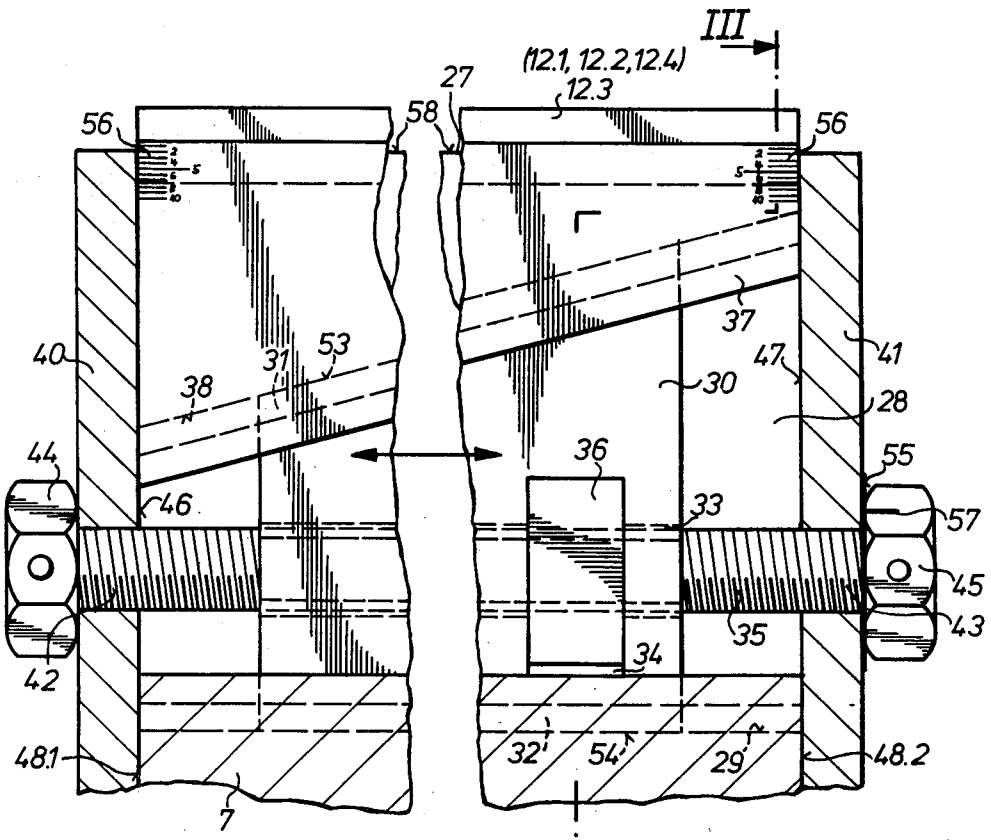
FIG. 2 is an elevation view, partly in section, taken along line II—II of FIG. 1.

A preferred embodiment of a mechanism for the radial adjustment of the supports 12.1 to 12.4 for the sections of sheets A, B, C, D of a transfer cylinder 7 is shown in FIGS. 2–4. Four axial grooves 28 are milled in the 4/2 counter cut bar and transfer cylinder 7, spaced from each other by 90°, parallel to the axis of the cylinder, and at the surface thereof. These grooves are open towards the periphery 27 of the 4/2 counter cut bar and transfer cylinder 7 as may be seen in FIG. 4. The bottom of each of the grooves 28 is executed as a T-shaped slot 29. A sliding wedge 30 is disposed in each groove 28 and is capable of being displaced to either side in such a manner that it cannot be lost. It has a top surface inclined at a slope of 1:10, and its top and bottom surfaces 53, 54 are shaped as T-shaped tongues 31, 32. The sliding wedge 30 is provided at its lower part with a longitudinal bore hole 33 and with a recess 34. The bore hole 33 serves to receive a screwed spindle 35. A square nut 36 is adjusted to fit into the recess 34. The T-shaped tongue 32 of the sliding wedge 30 meshes with the T-shaped slot 29 of the 4/2 counter cut bar and transfer cylinder 7, and the second tongue 31 meshes with a T-shaped slot 38 in a triangular or trapezoidal support block 37. Plastic supports, for example, the counter cut bars 12.1 to 12.4 are pressed into a U-shaped longitudinal groove 39 provided in the upper surface of block 37, which groove 39 extends parallel to the axis of cylinder 7. The cylinder grooves 28 are closed at either end by cover plates 40, 41 which are screwed to the sides 48.1, 48.2 of the 4/2 counter cut bar and transfer cylinder 7. The ends 42, 43 of the screwed spindle 35 are supported in bore holes provided in the cover plate 40, 41 and are capable of being rotated. Furthermore, hexagon nuts 44, 45 are screwed onto each of the ends 42, 43 of the screwed spindle 35 and are pinned to them.

The outside screw thread of the spindle 35 meshes with the inside screw thread of the square nut 36 and the sliding wedge 30 is shorter than the triangular support block 37. Therefore, enough space is left in the groove 28 for displacing the sliding wedge 30 to and fro by rotating the spindle 35. If, for example, a tool is set to the hexagon nut 44, and the spindle 35 is rotated in clockwise direction, the sliding wedge 30 is pulled to the left side by means of the square nut 36 engaged with the screwed spindle 35 as shown in FIG. 3. By this operation, the support block 37 is shifted towards the periphery 27 of the 4/2 counter cut bar and transfer cylinder 7, sliding vertically along the sliding surfaces 46, 47 of the cover plates 40, 41. That means that the supports or the counter cut bars 12.1 to 12.4 are shifted out of the periphery 27 of the 4/2 counter cut bar and transfer cylinder 7. If the screwed spindle 35 is rotated by means of the hexagon nut 44 in counter-clockwise direction, the sliding wedge 30 is shifted to the right by means of the square nut 36, as is shown in FIG. 3. As the sliding wedge 30 and the support block 37 are detachably keyed to each other by the T-shaped slot 38 and T-shaped tongues 31, the support block 37 follows the movement of the sliding wedge 30. In this case, the block 37 with the support or the counter cut bar 12.1 to 12.4 fixed on it, is moved towards the center of the 4/2 counter cut bar and transfer cylinder 7.

A mechanism similar to that used for adjustment of the supports or counter cut bars 12.1 to 12.4 respectively, is provided for adjusting the four cutting knives 11.1 to 11.4 carried on the 4/2 cutting knife cylinder 6. However, the cutting knives 11.1 to 11.4 are screwed to their corresponding support blocks 37.

In FIG. 4, the functioning of the several sets of pins 9.1 to 9.5 and 10.1 to 10.4 is shown by way of example by the set of pins 9.1 and 10.4 only. To enable a correct transfer of the sheet sections A, B, C, D onto the support of the counter cut bars 12.1 to 12.4 respectively, for each of the height adjusting mechanisms on the 4/2 counter cut bar and transfer cylinder 7, compensating sheet metal flaps 49 are provided. The first end 50 of the compensating sheet metal flap 49 is articulated to the block 37. The second end 51 of flap 49 is supported in a recess 52 of the 4/2 counter cut bar and transfer cylinder 7, and is capable of being rotated and displaced.

Measuring devices, such as scales 55 and/or 56, for taking readings of the adjusted height of the supports 12.1 to 12.4 are disposed at appropriate points; for example, at the side face of the cover plates 41, or at one side face of the support block 37. The adjusted height of the bars may be read from these scales in combination, for example, with a marking 57 on the hexagon nut 45 or with the surface 58 of the cylinder 7.

The present invention is not limited only to application in folders, but may be applied in any situation when sheet collecting and transferring operations are executed by means of cylinders equipped with pins. Furthermore, it will be obvious to one of ordinary skill in the art that while a preferred embodiment of a sheet transfer apparatus in accordance with the present invention has been fully and completely described hereinabove, a number of changes could be made without departing from the true spirit and scope of the invention. For example, suitable alternate means such as cams could be used to support the sheet stacks, the number of bars and knives on the counter cut and cutting cylinders could be varied, the actuating means for the sliding wedges could be hydraulic or pneumatic, and various changes could be made in the shapes of the slots and tongues. Accordingly, the present invention is to be limited only by the following claims.

What I claim is:

1. A sheet transfer apparatus for forming and transferring sheet stacks from printed webs leaving formers to a collecting and folding blade cylinder in a rotary web-fed printing press, said sheet transfer apparatus comprising:

a cutting knife cylinder having knives projecting radially outwardly from a peripheral surface thereof;

a spaced cooperating counter cut bar and transfer cylinder having a plurality of spaced support bars projecting radially outwardly from a peripheral surface of said counter cut bar and transfer cylinder, each said support bar cooperating with a complementary one of said cutting knifes to sever the web into sheet stacks;

a plurality of spaced pin sets on a peripheral surface of said collecting and folding blade cylinder, said pin sets cooperating with said support bars to receive said sheet stacks from said counter cut bar and transfer cylinder;

means for adjusting the projection of each said support bar from said peripheral surface of said transfer cylinder to force each of said sheet stacks onto its corresponding one of said spaced pin sets; and means for adjusting the projection of each said cutting knife to bring each said cutting knife into contact with its cooperating support bar whereby said projections of said support bars and said cutting knives may be adjusted to accomodate collect run production.

2. The apparatus of claim 1 wherein said counter cut bar and transfer cylinder includes a plurality of axially extending grooves at said peripheral surface of said counter cut bar and transfer cylinder.

3. The apparatus of claim 2 wherein each of said support bars is positioned in one of said grooves.

4. The apparatus of claim 3 wherein said means for adjusting the projection of said support bar includes a slidable wedge in said groove, said wedge contacting a support block which carries said support bar.

5. The apparatus of claim 4 wherein said slidable wedge is movable by a screw spindle passing therethrough.

6. The apparatus of claim 5 wherein said slidable wedge and said support block are joined by a cooperating tongue and slot.

7. The apparatus of claim 6 wherein measuring means are provided for measuring the projection of said support bars.

8. The apparatus of claim 1 wherein the projection of each said support bar is different from the projections of adjacent support bars.

9. The apparatus of claim 1 wherein said counter cut bar and transfer cylinder has four support bars, each of said support bars projecting from said peripheral surface of said counter cut bar and transfer cylinder a distance different from the projections of the other support bars whereby said sheet transfer apparatus can accomodate double collect run production.

* * * * *